US012035814B2

(12) United States Patent
Park

(10) Patent No.: US 12,035,814 B2
(45) Date of Patent: Jul. 16, 2024

(54) PREFABRICATED CHAIR

(71) Applicant: HNHANA CO., LTD., Seoul (KR)

(72) Inventor: Beom Jin Park, Seoul (KR)

(73) Assignee: HNHANA CO., LTD., Seoul (KR)

( * ) Notice: Subject to any disclaimer, the term of this patent is extended or adjusted under 35 U.S.C. 154(b) by 0 days.

(21) Appl. No.: 18/287,074

(22) PCT Filed: Apr. 18, 2022

(86) PCT No.: PCT/KR2022/005519
§ 371 (c)(1),
(2) Date: Oct. 16, 2023

(87) PCT Pub. No.: WO2022/255633
PCT Pub. Date: Dec. 8, 2022

(65) Prior Publication Data

US 2024/0099467 A1 Mar. 28, 2024

(30) Foreign Application Priority Data

May 31, 2021 (KR) ..... 10-2021-0070436

(51) Int. Cl.
*A47C 4/02* (2006.01)
*A47C 5/10* (2006.01)

(52) U.S. Cl.
CPC ..... *A47C 4/021* (2013.01); *A47C 4/024* (2013.01); *A47C 5/10* (2013.01)

(58) Field of Classification Search
CPC .. A47B 13/02; A47B 3/06; A47B 3/12; A47B 2013/026; A47C 4/02; A47C 4/021; A47C 4/024; A47C 5/10
(Continued)

(56) References Cited

U.S. PATENT DOCUMENTS 960,015 A * 5/1910 Holmes ..... A47C 4/02
297/440.16
1,397,764 A * 11/1921 Kunishige ..... A47B 3/12
108/158

(Continued)

FOREIGN PATENT DOCUMENTS

CN 209268875 U 8/2019
GB 2264229 A * 8/1993 ..... A47C 4/02

(Continued)

OTHER PUBLICATIONS 3 page PDF of translation of the written opinion mailed Sep. 2, 2022 in parent application PCT/KR2022/005519. (Year: 2022).*

(Continued)

*Primary Examiner* — Robert Canfield
(74) *Attorney, Agent, or Firm* — The Roy Gross Law Firm, LLC; Roy Gross

(57) ABSTRACT

The present invention relates to a prefabricated chair and, more particularly, to a prefabricated chair separated into two frames so that the volume thereof can be remarkably reduced, thereby facilitating storage and transportation and enabling easy assembly without a separate tool. The present invention relates to the prefabricated chair in which a first frame and a second frame are coupled, wherein the first frame includes: a pair of first and second leg bars of the front and rear; first and second upper horizontal support bars for connecting the upper portions of the first and second leg parts; an upper bracket for coupling the first and second upper horizontal support bars; first and second lower horizontal support bars for connecting the lower portion of the second leg part; and a lower bracket for coupling the first and second lower horizontal support bars, the second frame includes: a pair of third and fourth leg parts of the front and rear; a third upper horizontal support bar for connecting the upper portions of the third and fourth leg parts; and a third (Continued)

lower horizontal support bar for connecting the lower portions of the third and fourth leg parts, and the third upper horizontal support bar is fitted and coupled to the upper bracket and the third lower horizontal support bar is fitted and coupled to the lower bracket such that the first frame and the second frame are assembled in + shape.

3 Claims, 10 Drawing Sheets

(58) Field of Classification Search
USPC ..... 108/56.1, 156, 118–120, 158.11, 158.12, 108/180; 297/440.13, 440.14
See application file for complete search history.

(56) References Cited

U.S. PATENT DOCUMENTS 2,640,527 A * 6/1953 Kreizelman ..... A47C 4/02 297/440.13
4,974,906 A * 12/1990 Hines ..... A47C 4/021 297/440.13
5,499,883 A 3/1996 Heinzel
2010/0147200 A1* 6/2010 Polidoros ..... A47B 27/14 248/167
2015/0076871 A1* 3/2015 Werner ..... A47C 4/00 297/440.1
2018/0235359 A1* 8/2018 Reinhart ..... A47B 3/002

FOREIGN PATENT DOCUMENTS

JP 2009165732 A 7/2009
JP 3203330 U 3/2016
KR 200301441 Y1 1/2003
KR 20210000094 U 1/2021

OTHER PUBLICATIONS

PCT International Search Report for International Application No. PCT/KR2022/005519, mailed Sep. 2, 2022, 6pp.
PCT Written Opinion for International Application No. PCT/KR2022/005519, mailed Sep. 2, 2022, 3pp.

* cited by examiner

PREFABRICATED CHAIR

CROSS REFERENCE TO RELATED APPLICATIONS

This application is a National Phase of PCT Patent Application No. PCT/KR2022/005519 having International filing date of Apr. 18, 2022, which claims the benefit of priority of Korean Patent Application No. 10-2021-0070436, filed May 31, 2021, the contents of which are all incorporated herein by reference in their entirety.

FIELD OF INVENTION

The present invention relates to a prefabricated chair, and more specifically, a prefabricated chair composed of two frames assembled by crossing each other in a + shape, so that a volume in packaging can be significantly reduced, which makes it easy to store and transport, and can be easily assembled even without a separate tool.

BACKGROUND OF INVENTION

In the case of kitchen chairs, due to their simple structure, products with two sets of packaging, simple assembly of legs, and products with commercially possible designs were the main focus rather than developing prefabricated products.

However, due to the development of internet commerce, the number of cases that have to be packed one by one has increased, and the development of prefabricated chairs that can minimize the volume has become required.

In the case of a prefabricated chair, it is necessary not only to reduce the logistics cost by minimizing the volume, but also to lower the product cost and reduce the user's burden of assembly through a minimum assembly process.

SUMMARY OF INVENTION

Technical Problem to be Solved

The present invention has been made to solve the problems of the prior art, and the object of the present invention is to provide a prefabricated chair which is composed of two frames to be assembled by crossing each other in a + shape so that a volume thereof during packaging can be significantly reduced to thus enable easy storage and transportation, and further can be easily assembled even without a separate tool.

The problem to be solved by the present invention is not limited to those mentioned above, and other problems not mentioned herein will also be clearly understood by those skilled in the art from the description below.

Technical Solution

In order to achieve the above object, a prefabricated chair according to the present invention may include a first frame and a second frame coupled together, wherein the first frame may include: a pair of first and second leg parts in front and rear sides; first and second upper horizontal support bars for connecting upper portions of the first and second leg parts; an upper bracket for coupling the first and second upper horizontal support bars; first and second lower horizontal support bars for connecting a lower portion of the second leg part; and a lower bracket for coupling the first and second lower horizontal support bars, while the second frame may include: a pair of third and fourth leg parts in front and rear sides; a third upper horizontal support bar for connecting upper portions of the third and fourth leg parts; and a third lower horizontal support bar for connecting lower portions of the third and fourth leg parts, wherein the third upper horizontal support bar is fitted and coupled to the upper bracket while the third lower horizontal support bar is fitted and coupled to the lower bracket such that the first frame and the second frame are cross-assembled in + shape.

Further, with regard to the prefabricated chair according to the present invention, the upper bracket may be composed of: a pair of first and second connection pipes into which the first and second upper horizontal support bars are fitted in series, respectively; and a fitting groove which is disposed between the pair of first and second connection pipes and has a structure opened downward such that the third upper horizontal support bar is fitted therein, while the lower bracket may be composed of: a pair of third and fourth connection pipes into which the first and second lower horizontal support bars are fitted in series, respectively; and a fitting groove which is disposed between the pair of third and fourth connection pipes and has a structure opened upward such that the third lower horizontal support bar is fitted therein.

Further, with regard to the prefabricated chair according to the present invention, the upper bracket may be composed of: a pair of first and second connection pipes into which the first and second upper horizontal support bars are fitted in series, respectively; and a fitting groove which is disposed between the pair of first and second connection pipes and has a structure opened upward such that the third upper horizontal support bar is fitted therein, while the lower bracket may be composed of: a pair of third and fourth connection pipes into which the first and second lower horizontal support bars are fitted in series, respectively; and a fitting groove which is disposed between the pair of third and fourth connection pipes and has a structure opened downward such that the third lower horizontal support bar is fitted therein.

Further, with regard to the prefabricated chair according to the present invention, the upper bracket and the lower bracket may be coupled together in a state which the upper bracket is separated from at least one of the first and second upper horizontal support bars, while the lower bracket is separated from at least one of the first and second lower horizontal support bars.

Further, the prefabricated chair of the present invention is composed of a first frame and a second frame coupled together, wherein the first frame may include: a pair of first and second leg parts in front and rear sides; first and second upper horizontal support bars for connecting upper portions of the first and second leg parts; an upper bracket for coupling the first and second upper horizontal support bars; and a first lower horizontal support bar for connecting lower portions of the first and second leg parts, while the second frame may include: a pair of third and fourth leg parts in front and rear sides; a third upper horizontal support bar for connecting upper portions of the third and fourth leg parts; second and third lower horizontal support bars for connecting lower portions of the third and fourth leg parts; and a lower bracket for coupling the second and third lower horizontal support bars, wherein the first frame and the second frame are cross-assembled in + shape.

Further, with regard to the prefabricated chair according to the present invention, the upper bracket may be composed of: a pair of first and second connection pipes into which the first and second upper horizontal support bars are fitted in series, respectively; and a fitting groove which is disposed between the pair of first and second connection pipes and has a structure opened downward such that the third upper horizontal support bar is fitted therein, while the lower bracket may be composed of: a pair of third and fourth connection pipes into which the second and third lower horizontal support bars are fitted in series, respectively; and a fitting groove which is disposed between the pair of third and fourth connection pipes and has a structure opened downward such that the first lower horizontal support bar is fitted therein.

Further, the prefabricated chair of the present invention is composed of a first frame and a second frame crossed in + shape and coupled together, wherein the first frame may include: a pair of first and second leg parts in front and rear sides; a first upper horizontal support bar for connecting upper portions of the first and second leg parts; an upper bracket formed in the center of the first upper horizontal support bar; a first lower horizontal support bar for connecting lower portions of the first and second leg parts; and a lower bracket formed in the center of the first lower horizontal support bar, while the second frame may include: a pair of third and fourth leg parts in front and rear sides; a second upper horizontal support bar for connecting upper portions of the third and fourth leg parts; a second lower horizontal support bar for connecting lower portions of the third and fourth leg parts, wherein, at one end of the second lower horizontal support bar, a fitting guide groove having a structure concave upward or a fitting guide projection having a structure protruding downward is formed, wherein the second upper horizontal support bar is fitted and coupled to the upper bracket while the second lower horizontal support bar is fitted and coupled to the lower bracket so that the first frame and the second frame are cross-assembled in + shape.

Effect of Invention

According to the prefabricated chair of the present invention, this is composed of two frames to be assembled by crossing each other in + shape, so that a volume in packaging can be significantly reduced to thus make it easy to store and transport the same, and the chair may be effectively and easily assembled even without a separate tool.

The effects of the present invention are not particularly limited to those mentioned above, and other effects not mentioned therein will also be clearly understood by those skilled in the art from the description below.

BEST MODE OF PREFERRED EMBODIMENTS OF INVENTION

Hereinafter, preferred embodiments of the present invention will be described in detail.

In describing the present invention, if it is determined that a detailed description of related known functions or configurations may unnecessarily obscure the gist of the present invention, the detailed description will be omitted. Further, the following terms are terms defined in consideration of functions in the present invention, which may vary according to the intention of a user or operator, or relevant precedent. Therefore, the definition should be made based on the contents throughout this specification.

Figure 1:
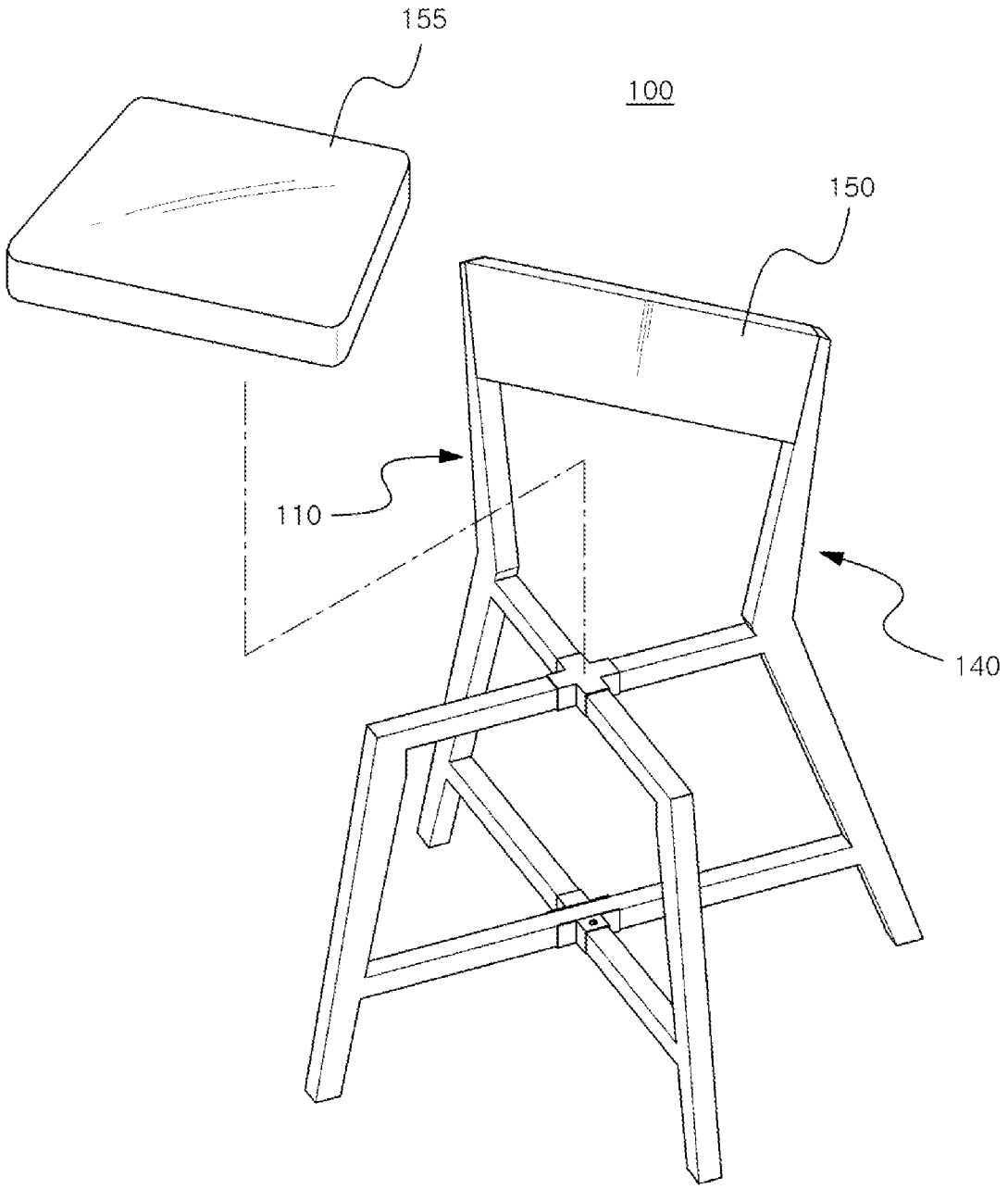
FIG. 1 is a perspective view showing a first embodiment of the prefabricated chair according to the present invention.
Figure 2:
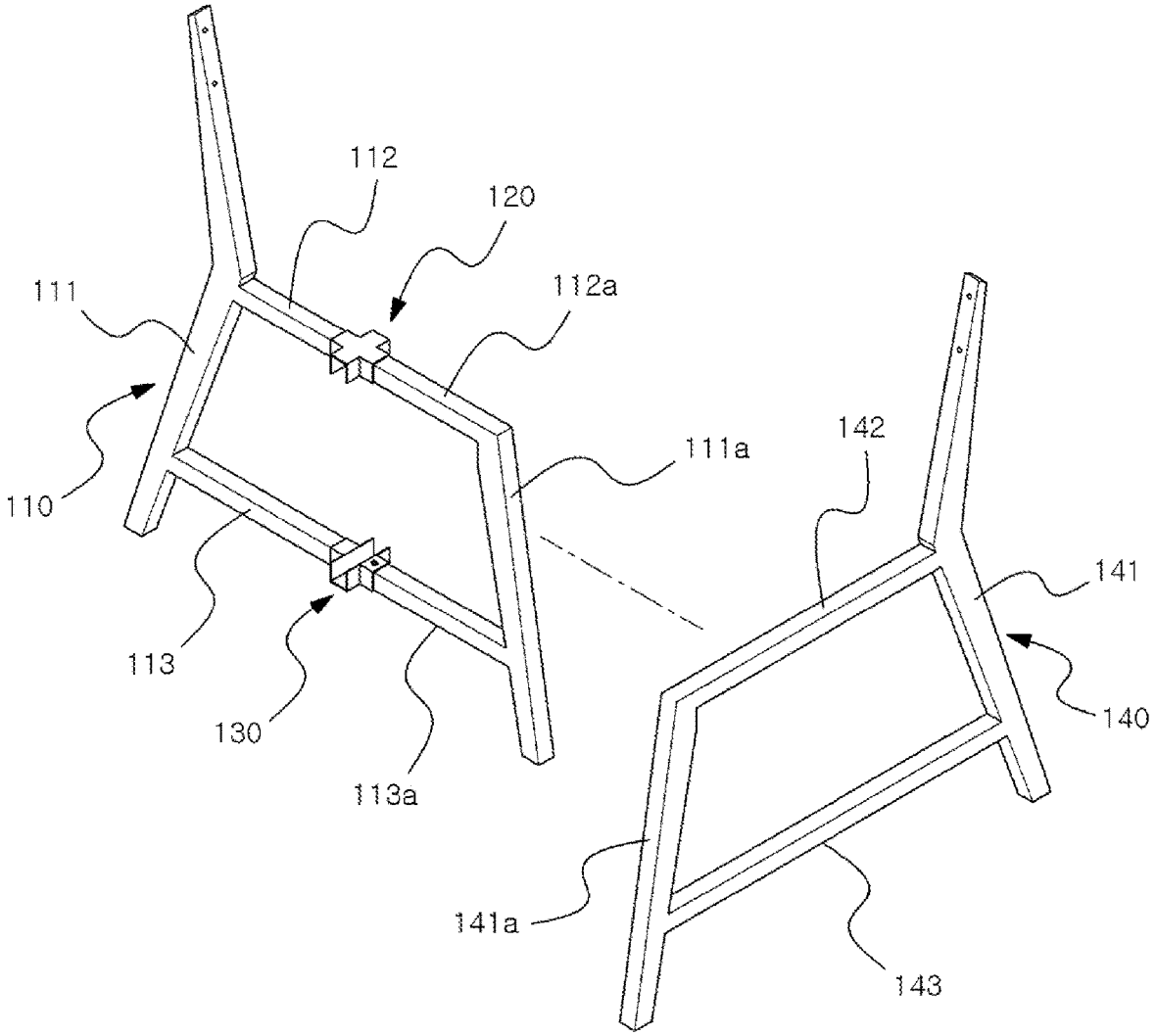
FIG. 2 is an exploded perspective view of the state which the first frame and the second frame of the present invention are disassembled.

FIG. 1 is a perspective view showing a first embodiment of the prefabricated chair according to the present invention; FIG. 2 is an exploded perspective view of the state which the first frame and the second frame of the present invention are disassembled; and FIG. 3 is a perspective view showing how the first frame and the second frame of the present invention are assembled.

Figure 3:
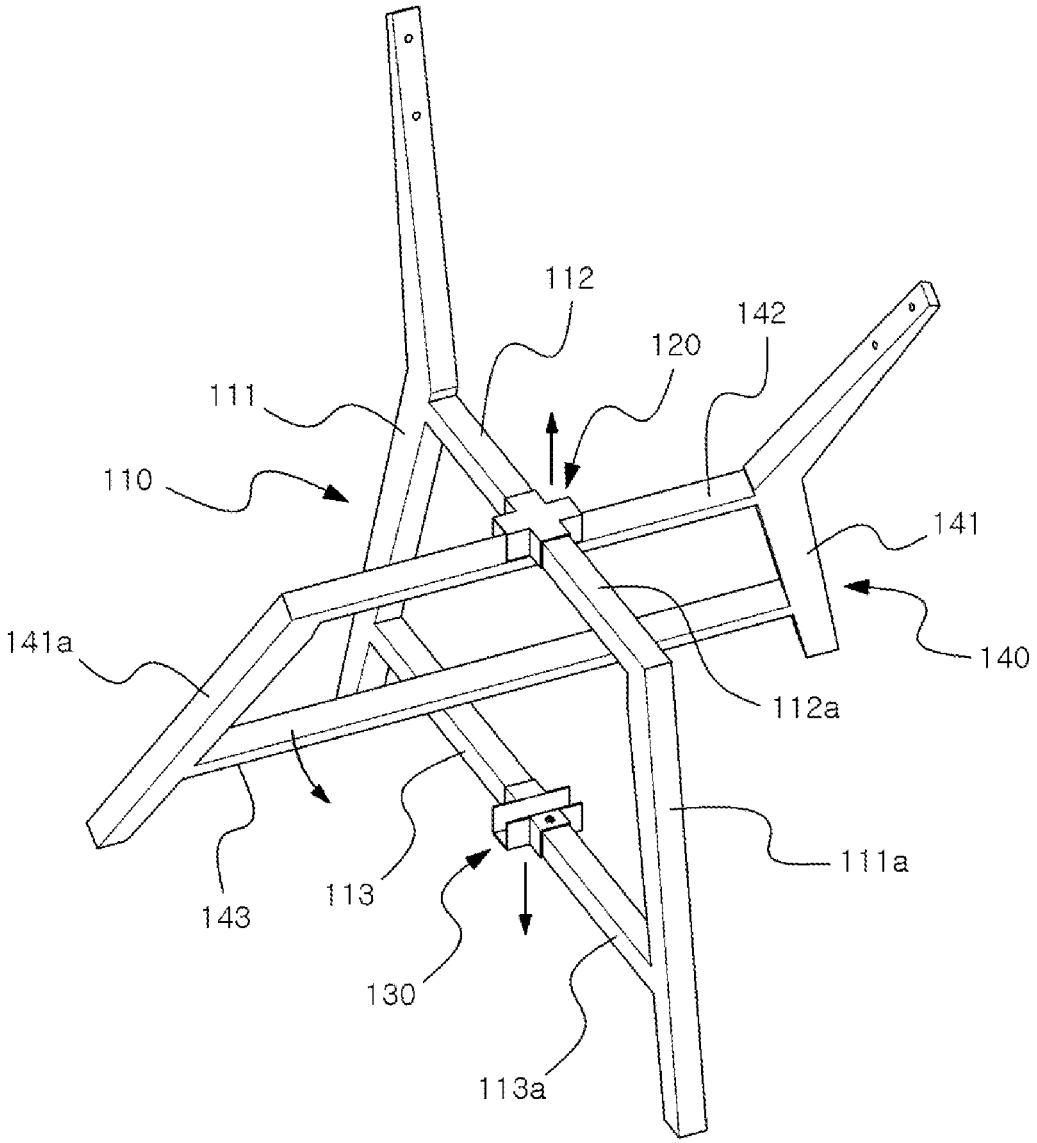
FIG. 3 is a perspective view showing how to assemble the first frame and the second frame of the present invention.

Referring to FIGS. 1 to 3, the prefabricated chair 100 according to the present invention may roughly include a first frame 110, a second frame 140, a backrest part 150 and a cushion part.

Herein, the first frame 110 and the second frame 140 may be assembled in a manner of crossing in a + shape.

The first frame 110 of the present invention may be configured to include: a pair of first and second leg parts 111 and 111*a* in front and rear sides; first and second upper horizontal support bars 112 and 112*a* for connecting upper portions of the first and second leg parts 111 and 111*a*; an upper bracket 120 for coupling the first and second upper horizontal support bars 112 and 112*a*; first and second lower horizontal support bars 113 and 113*a* for connecting lower portions of the first and second leg parts 111 and 111*a*; and a lower bracket 130 for coupling the first and second lower horizontal support bars 113 and 113*a*.

The upper bracket 120 may be composed of: a pair of first and second connection pipes 121 and 121*a* into which the first and second upper horizontal support bars 112 and 112*a* are fitted in series, respectively; and a first fitting groove 122 which is disposed between the pair of first and second connection pipes 121 and 121*a* and has a structure opened downward such that a third upper horizontal support bar 142 is fitted therein.

The lower bracket 130 may be composed of: a pair of third and fourth connection pipes 131 and 131*a* into which the first and second lower horizontal support bars 113 and 113*a* are fitted in series, respectively; a second fitting groove 132 which is disposed between the pair of third and fourth connection pipes 131 and 131*a* and has a structure opened upward such that a third lower horizontal support bar 143*a* is fitted therein.

The second frame 140 of the present invention may be configured to include: a pair of third and fourth leg parts 141 and 141*a* in front and rear sides; the third upper horizontal support bar 142 for connecting upper portions of the third and fourth leg parts 141 and 141*a*; and the third lower horizontal support bar 143*a* for connecting lower portions of the third and fourth leg parts 141 and 141*a*.

In review of a process of assembling the first frame and the second frame with reference to FIG. 3, the second frame may be inserted into a space between the first and second upper horizontal support bars and the first and second lower horizontal support bars in the first frame in a state which the second frame is tilted down. Then, in a state which the third upper horizontal support bar in the second frame is placed in the fitting groove of the upper bracket, the third lower horizontal support bar in the second frame may be pulled and then forcibly fitted into the fitting groove of the lower bracket, thereby completing the assembly.

At this time, since the upper and lower horizontal support bars in the first frame are formed in a structure coupled through the upper bracket and the lower bracket, respectively, it becomes an elastic structure enabling formation of a vertical clearance when the third lower horizontal support bar is pulled, therefore, the above-described forcible fitting is possibly achieved.

Figure 4:
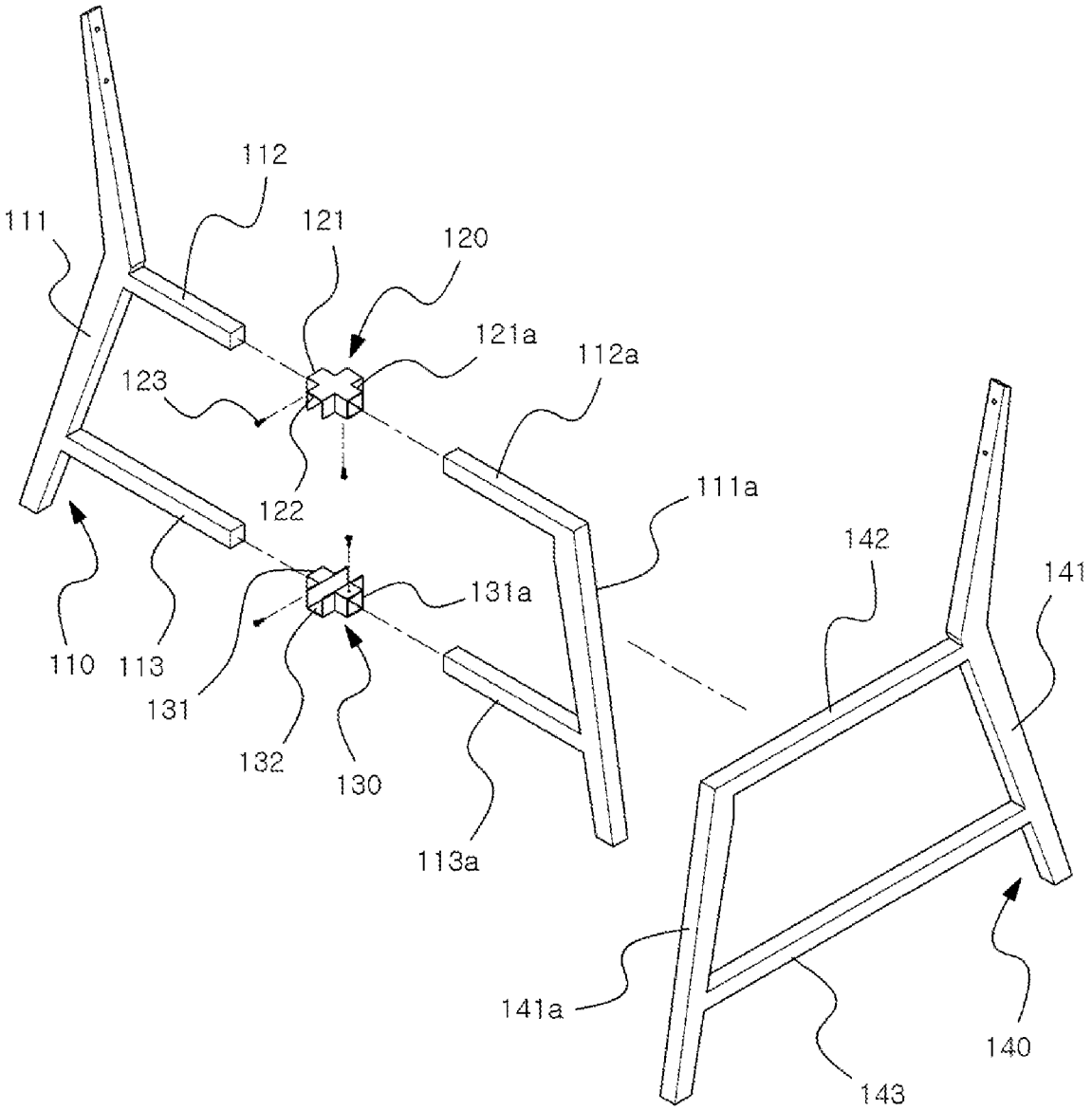
FIG. 4 illustrates a structure in which the first frame of the present invention is disassembled left and right to the bracket.
Figure 5:
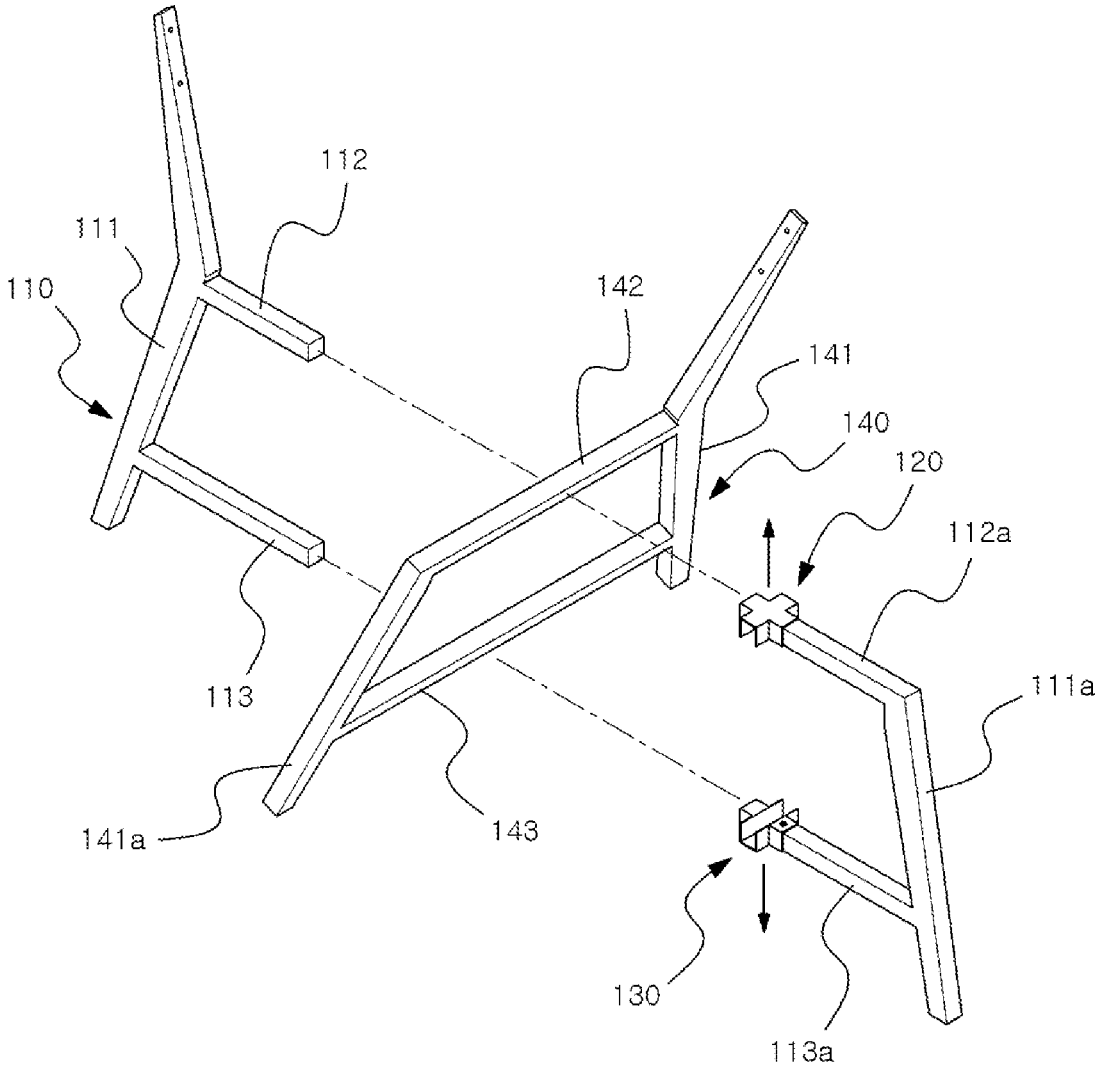
FIG. 5 illustrates the first frame of the present invention which is assembled with the second frame in a partially disassembled state.

FIG. 4 illustrates a structure in which the first frame of the present invention is disassembled left and right to the bracket; and FIG. 5 illustrates the first frame of the present invention which is assembled with the second frame in a partially disassembled state.

Referring to FIGS. 4 and 5, with regard to the first frame 110 of the present invention, the upper bracket 120 may be separated from the first and second upper horizontal support bars 112 and 112*a*, while the lower bracket 130 may be separated from the first and second lower horizontal support bars 113 and 113*a*.

Therefore, unlike the assembly process of FIG. 3 described above, the first frame 110 can be assembled with the second frame 140 in a state which either the left or right side to the upper bracket 120 and the lower bracket 130 is disassembled. In this case, since the second upper horizontal support bar 112*a* and the second lower horizontal support bar 113*a* become free ends that flow relatively smoothly up and down, these can be more easily assembled with the second frame 140.

The third upper horizontal support bar 142 and the third lower horizontal support bar 143*a* of the second frame 140 are fitted and coupled to the first fitting groove 122 and the second fitting groove 132 of the upper bracket 120 and the lower bracket 130, respectively, followed by inserting the first upper horizontal support bar 112 and the first lower horizontal support bar 113 into the first connection pipe 121 and the third connection pipe 131, and then, fixing the same with a fastening member 123 such as a bolt.

Figure 6:
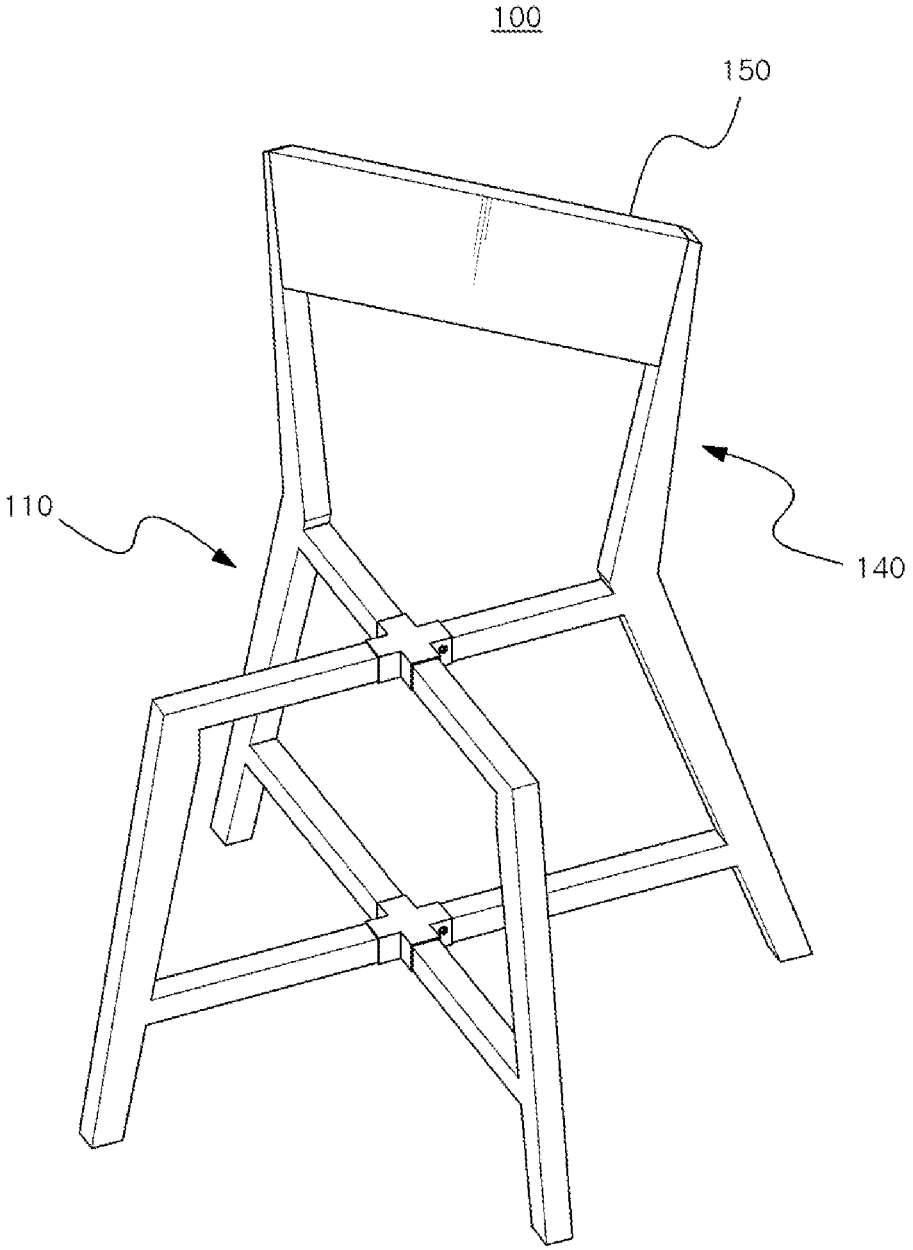
FIG. 6 is a perspective view showing a second embodiment of the prefabricated chair according to the present invention.
Figure 7:
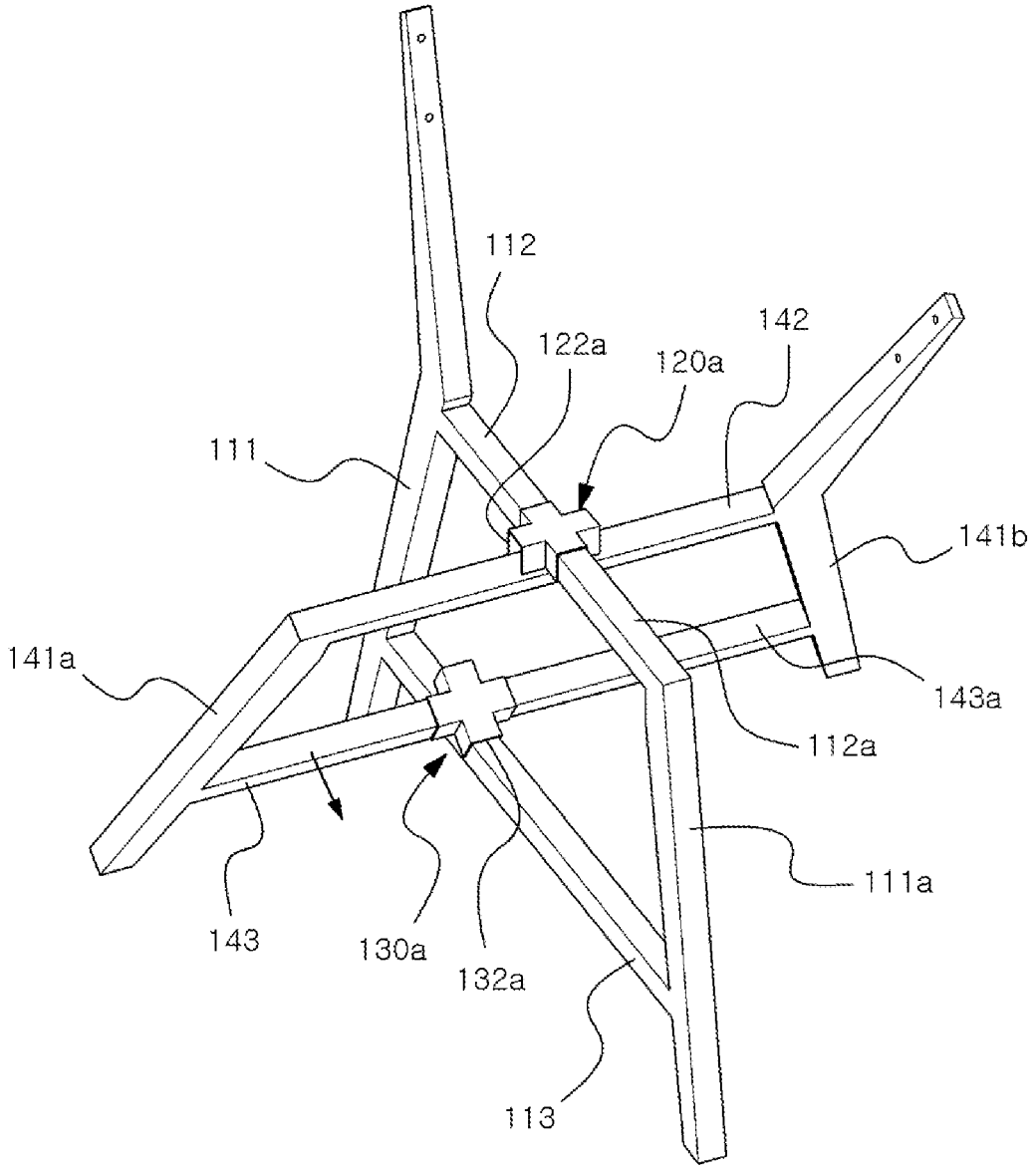
FIG. 7 is a perspective view showing how to assemble the first frame and the second frame of FIG. 6.

FIG. 6 is a perspective view showing a second embodiment of the prefabricated chair according to the present invention; and FIG. 7 is a perspective view showing how to assemble the first frame and the second frame of FIG. 6.

Referring to FIGS. 6 and 7, the present embodiment proposes a structure for facilitating the assembly process by forcibly fitting each frame in the first embodiment described above.

First, the first frame 110 may include: a pair of first and second leg parts 111 and 111*a* in front and rear sides; first and second upper horizontal support bars 112 and 112*a* for connecting upper portions of the first and second leg parts 111 and 111*a*; an upper bracket 120*a* for coupling the first and second upper horizontal support bars 112 and 112*a*; and a first lower horizontal support bar 113 for connecting lower portions of the first and second leg parts 111 and 111*a*.

The second frame 140 may include: a pair of third and fourth leg parts 141 and 141*a* in front and rear sides; a third upper horizontal support bar 142 for connecting upper portions of the third and fourth leg parts 141 and 141*a*; second and third lower horizontal support bars 143 and 143*a* for connecting lower portions of the third and fourth leg parts 141 and 141*a*; and a lower bracket 130*a* for coupling the second and third lower horizontal support bars 143 and 143*a*.

Herein, the upper bracket 120*a* may be composed of: a pair of first and second connection pipes 121 and 121*a* into which the first and second upper horizontal support bars 112 and 112*a* are fitted in series, respectively; a third fitting groove 122*a* which is disposed between the pair of first and second connection pipes 121 and 121*a*, and has a structure opened downward such that the third upper horizontal support bar 142 is fitted therein.

Similarly, the lower bracket 130*a* may be composed of: a pair of third and fourth connection pipes 131 and 131*a* into which the second and third lower horizontal support bars 143 and 143*a* are fitted in series, respectively; and a fourth fitting groove 132*a* which is disposed between the pair of third and fourth connection pipes 131 and 131*a*, and has a structure opened downward such that the first lower horizontal support bar 113 is fitted therein.

That is, when compared to the first embodiment, there is a difference in that an upper bracket coupling structure is formed in the first frame while the second frame has a lower bracket coupling structure.

Looking at the assembly process, the second frame 140 may be inserted into a space between the first and second upper horizontal support bars 112 and 112*a* and the first lower horizontal support bar 113 in the first frame 110, in a state which the second frame 140 is tilted down. Then, in a state which the third upper horizontal support bar 142 in the second frame 140 is placed in the fitting groove 122*a* of the upper bracket 120*a*, the second and third lower horizontal support bars 143 and 143*a* in the second frame 140 may be pulled and then coupled to the first lower horizontal support bar 113, wherein the fourth fitting groove 132*a* of the lower bracket 130 provided in the second frame 140 has a structure corresponding to a length direction of the first lower horizontal support bar in the first frame 110, thereby being easily coupled as compared to the first embodiment described above.

That is, in the present embodiment, since the lower bracket formed on the second frame may serve as a guide rail for the first lower horizontal support bar of the first frame, thereby facilitating assembly.

Figure 8:
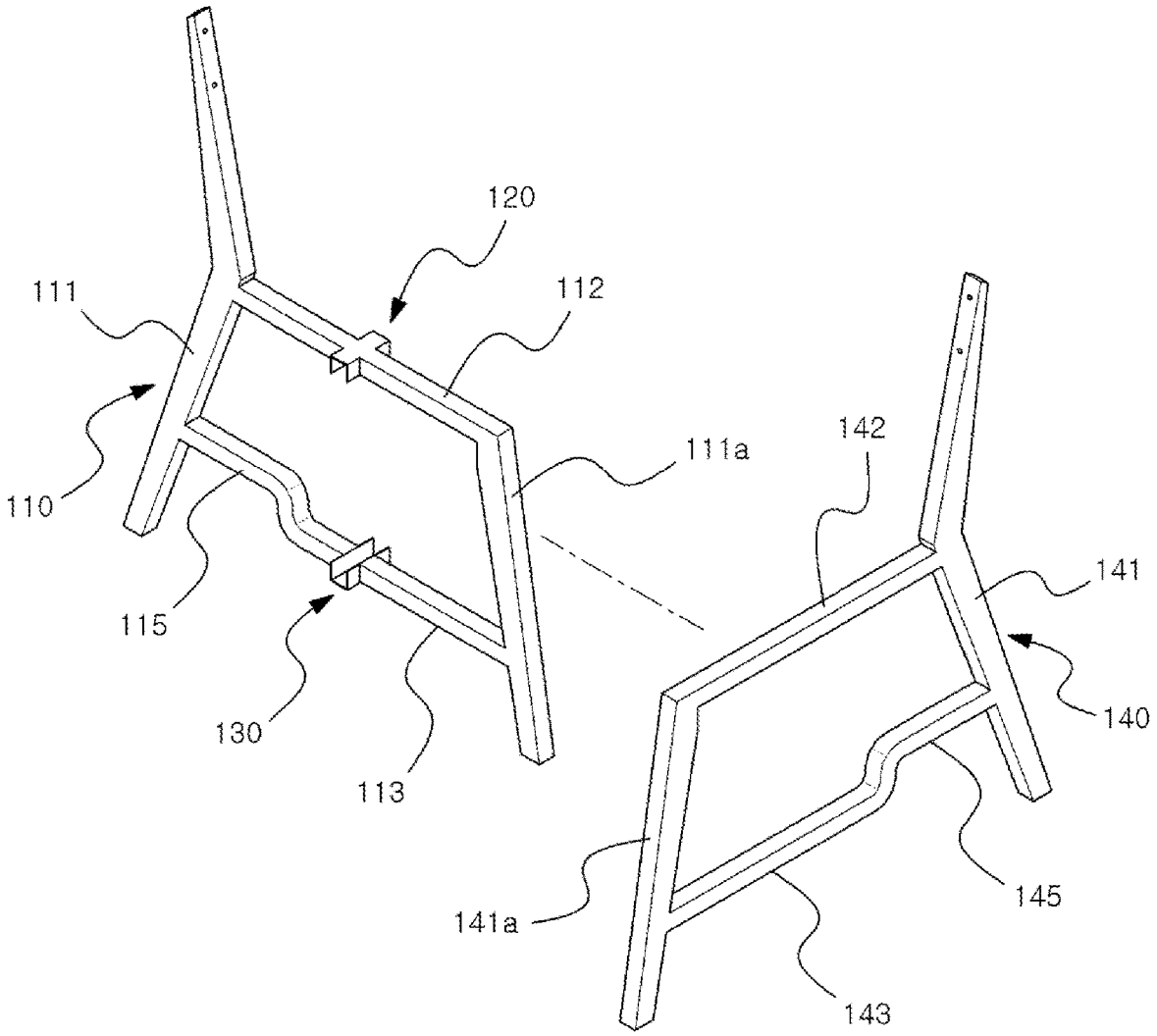
FIG. 8 illustrates a third embodiment of the prefabricated chair according to the present invention.
Figure 9:
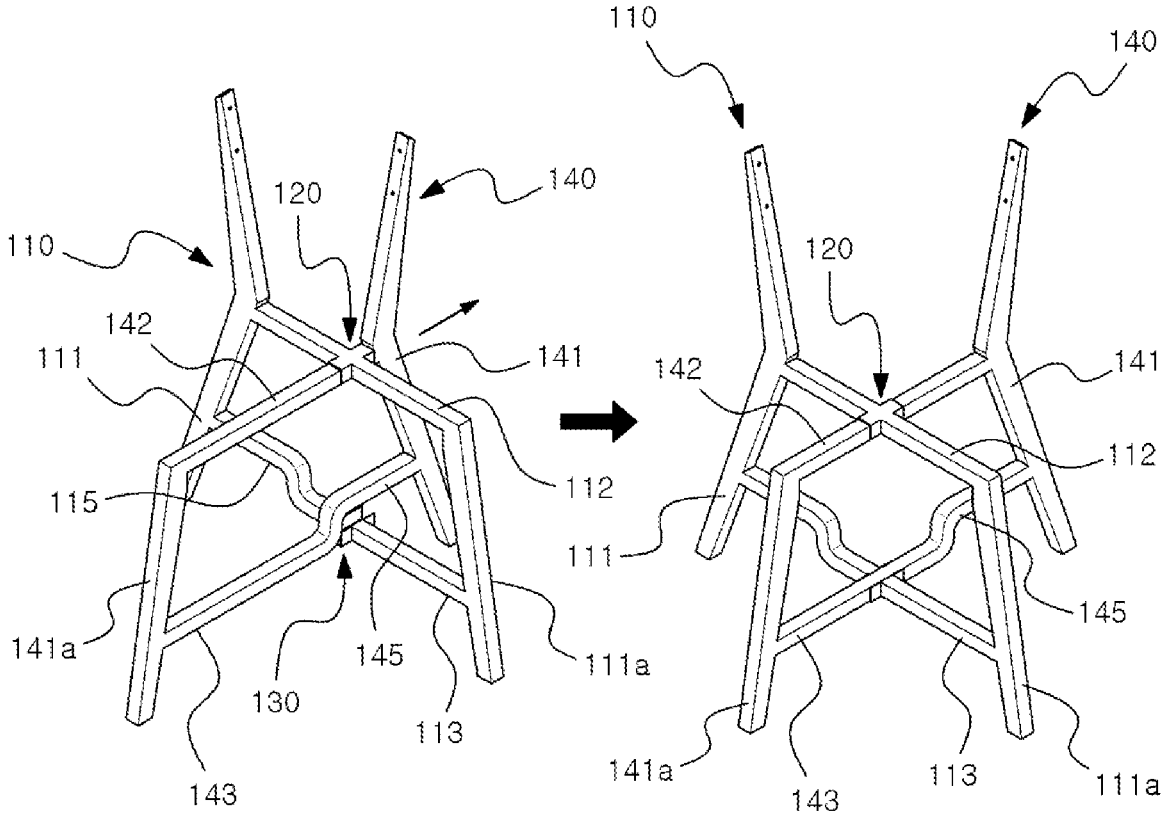
FIG. 9 illustrates how to assemble the frames of FIG. 8, respectively.

FIG. 8 illustrates a third embodiment of the prefabricated chair according to the present invention; and FIG. 9 illustrates how to assemble the frames of FIG. 8, respectively.

Referring to FIGS. 8 and 9, the prefabricated chair according to the present embodiment may be composed of a first frame 110 and a second frame 140 crossed in + shape and coupled together, wherein the first frame 110 may include: a pair of first and second leg parts 111 and 111*a* in front and rear sides; a first upper horizontal support bar 112 for connecting upper portions of the first and second leg parts 111 and 111*a*; an upper bracket 113 formed in the center of the first upper horizontal support bar 112; a first lower horizontal support bar 113 for connecting lower portions of the first and second leg parts 111 and 111*a*; and a lower bracket 130 formed in the center of the first lower horizontal support bar 113.

In this regard, the upper bracket 120 and the lower bracket 130 may have a structure in which these brackets are coupled to the upper horizontal support bar and the lower horizontal support bar as in the above-described embodiment, or may be integrally configured as shown in the above drawings.

Further, the second frame 140 may include: a pair of third and fourth leg parts 141 and 141*a* in front and rear sides; a second upper horizontal support bar 142 for connecting upper portions of the third and fourth leg parts 141 and 141*a*; a second lower horizontal support bar 143 for connecting lower portions of the third and fourth leg parts 141 and 141*a*.

Herein, the second upper horizontal support bar 142 may be fitted and coupled to the upper bracket 120 while the second lower horizontal support bar 143 may be fitted and coupled to the lower bracket 130.

Unlike the previously described embodiment, the present embodiment is characterized in that a fitting guide groove having a structure concave upward is formed at one end of the second lower horizontal support bar.

For example, in the case of the first embodiment, as shown in FIG. 3, assembly is performed by pulling the second frame in a state which the second frame is tilted and placed in the first frame. On the other hand, in the case of the present embodiment, the second frame 140 is inserted into the first frame 110 and fitted through a fitting guide groove 145 with a narrow vertical distance, followed by pulling the second frame 140 to one side in a state which the second frame 140 is coupled to the upper bracket 120 so that the second lower horizontal support bar 143 is coupled to the lower bracket 130, thereby completing the assembly.

In fact, FIG. 9 illustrates that the fitting guide grooves 145 and 115 are formed in not only the second frame but also the first frame. This is to enhance aesthetic effects by forming a left-right symmetrical structure.

As such, the present embodiment has the advantage of easily performing the assembly through a simple process of forming the fitting guide groove in the second frame.

Figure 10:
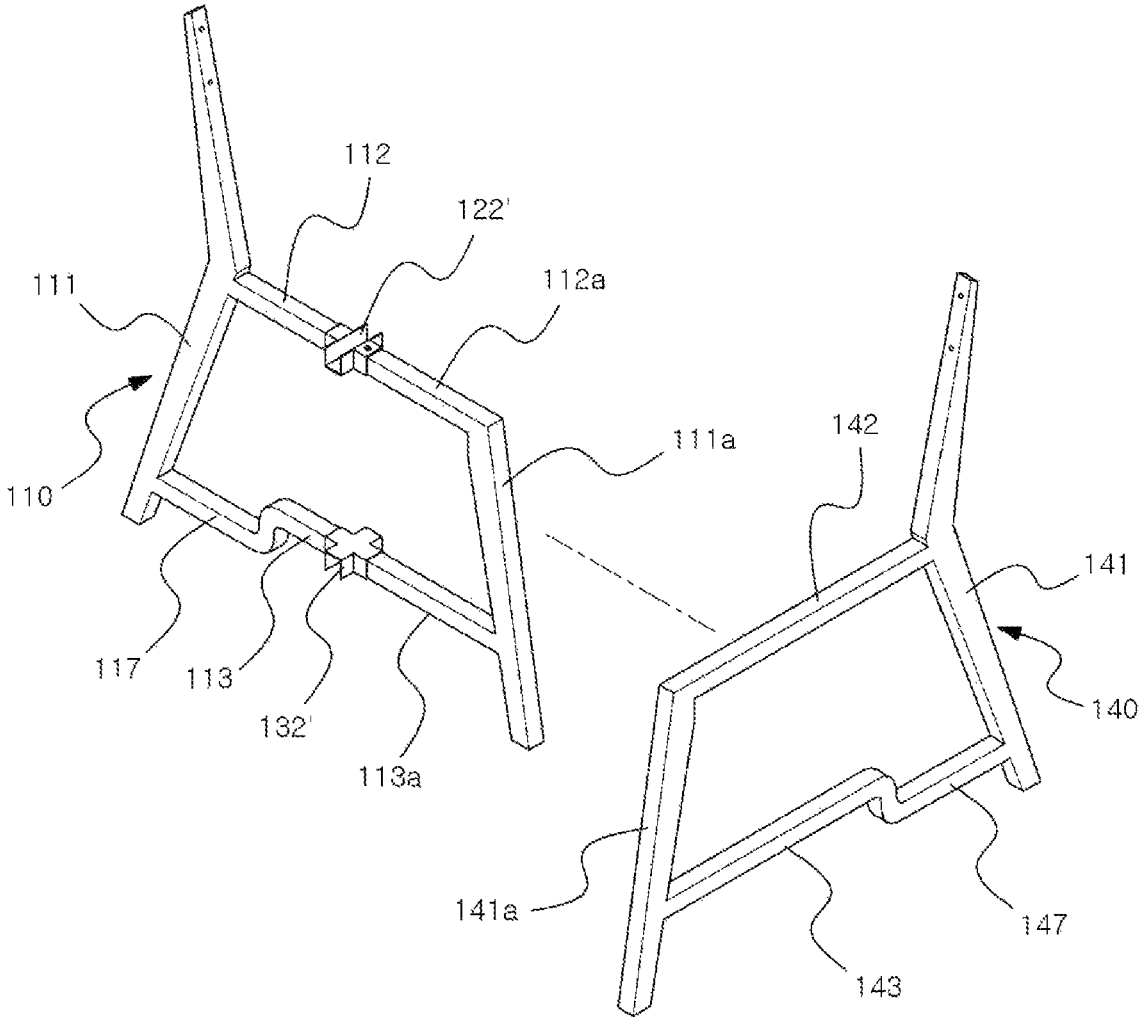
FIG. 10 is a perspective view showing a fourth embodiment of the prefabricated chair according to the present invention.

FIG. 10 is a perspective view showing a fourth embodiment of the prefabricated chair according to the present invention.

Referring to FIG. 10, the present embodiment has a difference in the structure of the upper bracket 120 and the lower bracket 130, as compared to the first embodiment.

Specifically, the upper bracket 120 may be composed of: a pair of first and second connection pipes 121 and 121*a* into which the first and second upper horizontal support bars 112 and 112*a* are fitted in series, respectively; and a first fitting groove 122' which is disposed between the pair of first and second connection pipes 121 and 121*a*, and has a structure opened upward such that the third upper horizontal support bar 142 is fitted therein.

Further, the lower bracket 130 may be composed of: a pair of third and fourth connection pipes 131 and 131*a* into which the first and second lower horizontal support bars 113 and 113*a* are fitted in series, respectively; and a second fitting groove 132' which is disposed between the pair of third and fourth connection pipes 131 and 131*a*, and has a structure opened downward such that the third lower horizontal support bar 143*a* is fitted therein.

That is, the fitting groove of the upper bracket may have an upper open structure, while the fitting groove of the lower bracket may be altered into a lower open structure.

In this case, the third upper horizontal support bar is disposed above the first and second upper horizontal support bars while placing the third lower horizontal support bar below the first and second lower horizontal support bars, and then, the third upper horizontal support bar and the third lower horizontal support bar in the second frame may be forcibly fitted in the brackets, respectively. At this time, the upper bracket may be slightly bent downward while the lower bracket may be slightly bent upward.

Meanwhile, the present embodiment has a difference in that fitting guide projections 117 and 147 are formed instead of the fitting guide grooves in the first and second frames, respectively, as compared to the third embodiment. The reason of this configuration is because the assembly may be performed in a state which the first frame is inserted into the second frame due to structural changes of the upper bracket and the lower bracket.

As such, the fitting guide groove or the fitting guide projection formed in the second frame may allow a vertical spacing between the upper and lower horizontal support bars narrow or wide, whereby the assembly with the first frame is smoothly performed.

The present invention described above is only exemplary, and those skilled in the art will appreciate that various modifications and other equivalent embodiments are possible therefrom. Therefore, it will be well understood that the present invention is not limited to the forms mentioned in the detailed description above. Accordingly, the true technical scope of the present invention to be protected should be determined by the technical spirit of the appended claims. In addition, it is to be understood that the present invention includes all modifications, equivalents and alternatives within the spirit and scope of the present invention as defined by the appended claims.

Mode for Carrying Out Preferred Embodiment of Invention

The mode for carrying out the present invention has also been described in the best mode of preferred embodiments of invention above.

INDUSTRIAL APPLICABILITY

Since the prefabricated chair of the present invention consists of two frames that are crossed to each other in + shape and assembled, a volume in packaging can be significantly reduced to enable easy storage and transportation, and the chair can be easily assembled even without a separate tool, thereby having industrial applicability.

The invention claimed is:

1. A prefabricated chair comprising a first frame and a second frame coupled together, wherein the first frame includes:

a pair of first and second leg parts in front and rear sides; first and second upper horizontal support bars for connecting upper portions of the first and second leg parts; an upper bracket for coupling the first and second upper horizontal support bars; first and second lower horizontal support bars for connecting lower portions of the first and second leg parts; and a lower bracket for coupling the first and second lower horizontal support bars, while the second frame includes: a pair of third and fourth leg parts in front and rear sides; a third upper horizontal support bar for connecting upper portions of the third and fourth leg parts; and a third lower horizontal support bar for connecting lower portions of the third and fourth leg parts, wherein the third upper horizontal support bar is fitted and coupled to the upper bracket while the third lower horizontal support bar is fitted and coupled to the lower bracket such that the first frame and the second frame are cross-assembled in + shape, wherein the upper bracket is composed of:

a pair of first and second connection pipes into which the first and second upper horizontal support bars are fitted in series, respectively; and a fitting groove which is disposed between the pair of first and second connection pipes and has a structure opened downward such that the third upper horizontal support bar is fitted therein, while the lower bracket is composed of:

a pair of third and fourth connection pipes into which the first and second lower horizontal support bars are fitted in series, respectively; and a fitting groove which is disposed between the pair of third and fourth connection pipes and has a structure opened upward such that the third lower horizontal support bar is fitted therein.

2. A prefabricated chair, comprising a first frame and a second frame crossed in + shape and coupled together, wherein the first frame includes:

a pair of first and second leg parts in front and rear sides; a first upper horizontal support bar for connecting upper portions of the first and second leg parts; an upper bracket formed in the center of the first upper horizontal support bar; a first lower horizontal support bar for connecting lower portions of the first and second leg parts; and a lower bracket formed in the center of the first lower horizontal support bar, while the second frame includes:

a pair of third and fourth leg parts in front and rear sides; a second upper horizontal support bar for connecting upper portions of the third and fourth leg parts; a second lower horizontal support bar for connecting lower portions of the third and fourth leg parts, wherein, at one end of the second lower horizontal support bar, a fitting guide groove having a structure concave upward or a fitting guide projection having a structure protruding downward is formed, and wherein the second upper horizontal support bar is fitted and coupled to the upper bracket while the second lower horizontal support bar is fitted and coupled to the lower bracket, so that the first frame and the second frame are cross-assembled in + shape.

3. A prefabricated chair comprising a first frame and a second frame coupled together, wherein the first frame includes:

a pair of first and second leg parts in front and rear sides; first and second upper horizontal support bars for connecting upper portions of the first and second leg parts; an upper bracket for coupling the first and second upper horizontal support bars; first and second lower horizontal support bars for connecting lower portions of the first and second leg parts; and a lower bracket for coupling the first and second lower horizontal support bars, while the second frame includes: a pair of third and fourth leg parts in front and rear sides; a third upper horizontal support bar for connecting upper portions of the third and fourth leg parts; and a third lower horizontal support bar for connecting lower portions of the third and fourth leg parts, wherein the third upper horizontal support bar is fitted and coupled to the upper bracket while the third lower horizontal support bar is fitted and coupled to the lower bracket such that the first frame and the second frame are cross-assembled in + shape, wherein the upper bracket is composed of:

a pair of first and second connection pipes into which the first and second upper horizontal support bars are fitted in series, respectively; and a fitting groove which is disposed between the pair of first and second connection pipes and has a structure opened upward such that the third upper horizontal support bar is fitted therein, while the lower bracket is composed of:

a pair of third and fourth connection pipes into which the first and second lower horizontal support bars are fitted in series, respectively; and a fitting groove which is disposed between the pair of third and fourth connection pipes and has a structure opened downward such that the third lower horizontal support bar is fitted therein.

* * * * *